US007101058B2

(12) United States Patent
Prell et al.

(10) Patent No.: US 7,101,058 B2
(45) Date of Patent: Sep. 5, 2006

(54) LIGHT ASSEMBLY

(75) Inventors: Edward T. Prell, Chicago, IL (US); Brad M. Baber, Arlington Heights, IL (US); Frankie Leung, Schaumburg, IL (US); Markus Allemann, Grayslake, IL (US); Walter Bernardi, Highland Park, IL (US)

(73) Assignee: Robert Bosch GmbH, Stuttgart (DE)

( * ) Notice: Subject to any disclaimer, the term of this patent is extended or adjusted under 35 U.S.C. 154(b) by 139 days.

(21) Appl. No.: 10/822,622

(22) Filed: Apr. 12, 2004

(65) Prior Publication Data

US 2005/0073836 A1 Apr. 7, 2005

Related U.S. Application Data

(63) Continuation-in-part of application No. 10/680,632, filed on Oct. 7, 2003, and a continuation-in-part of application No. 10/680,513, filed on Oct. 7, 2003.

(60) Provisional application No. 60/509,360, filed on Oct. 7, 2003.

(51) Int. Cl.
*F21V 33/00* (2006.01)

(52) U.S. Cl. ..... 362/191; 362/396; 362/109

(58) Field of Classification Search ..... 362/190–191, 362/119–120, 396, 253, 109
See application file for complete search history.

(56) References Cited

U.S. PATENT DOCUMENTS

| | | | | |
|---|---|---|---|---|
| 1,181,261 | A | 5/1916 | Schmidt | |
| 1,603,986 | A | 10/1926 | Rosenberg | |
| 2,310,166 | A | 2/1943 | Way | |
| 2,525,588 | A | 10/1950 | Cameron et al. | |
| 2,588,288 | A | 3/1952 | Pohanka | |
| 2,822,615 | A | 2/1958 | Durst et al. | |
| 3,023,306 | A | 2/1962 | Kester | |
| 3,393,312 | A | 7/1968 | Dahl | 362/190 |
| 4,414,299 | A * | 11/1983 | Ansell | 429/104 |
| 4,515,295 | A | 5/1985 | Dougherty | |
| 4,833,782 | A | 5/1989 | Smith | |
| 4,887,193 | A | 12/1989 | Dieckmann | |
| 5,664,875 | A | 9/1997 | Hegedus | 362/191 |

(Continued)

FOREIGN PATENT DOCUMENTS

| | | |
|---|---|---|
| DE | 3144034 | 5/1983 |

(Continued)

*Primary Examiner*—Ali Alavi
(74) *Attorney, Agent, or Firm*—Maginot, Moore & Beck

(57) ABSTRACT

A light attachment that can be readily mounted on a variety of tools and tool support fixtures and other support structures includes a light portion supported on a mounting portion by a flexible gooseneck cable. The mounting portion includes a housing that defines a male-female attachment element configured to slidingly mate with a complementary attachment element formed on the body of the power tool. In a preferred embodiment, the attachment element has a dovetail shape for sliding engagement within a complementary shaped notch in the body of the tool. The housing contains a power source for the light portion. The light portion incorporates an on-off switch that is actuated by rotating a component that is threadedly engaged within the housing. The housing supports a printed circuit board to which the power supply wires are attached. The circuit board also carries a spring contact switch element that completes an electrical circuit to energize the light portion when the spring contact is pressed against the circuit board. Power is supplied through the circuit board and switch to an LED light element. The LED is disposed within the housing so that the rotatable component can push the base of the LED into the spring switch to close the electrical circuit.

33 Claims, 5 Drawing Sheets

U.S. PATENT DOCUMENTS

| | | | | |
|---|---|---|---|---|
| 5,793,130 | A | 8/1998 | Anderson | |
| 5,797,670 | A | 8/1998 | Snoke et al. | |
| 6,422,724 | B1 | 7/2002 | Monteiro | 362/486 |
| 6,502,949 | B1 * | 1/2003 | Horiyama et al. | 362/119 |
| 6,616,295 | B1 | 9/2003 | Sako et al. | |
| 2005/0111214 | A1 * | 5/2005 | Zeiler | 362/119 |

FOREIGN PATENT DOCUMENTS

| | | |
|---|---|---|
| FR | 2523891 | 9/1983 |
| WO | WO 98/06975 | 2/1998 |

* cited by examiner

LIGHT ASSEMBLY

This application is a continuation-in-part of both (i) co-pending application Ser. No. 10/680,513, filed on Oct. 7, 2003, and (ii) co-pending application Ser. No. 10/680,632, filed on Oct. 7, 2003. The disclosure of each of the above-identified utility patent applications is hereby totally incorporated by reference in its entirety.

Also, this application claims the benefit of U.S. Provisional Application Ser. No. 60/509,360, filed Oct. 7, 2003. The disclosure of this provisional patent application is hereby totally incorporated by reference in its entirety.

BACKGROUND OF THE INVENTION

The present invention relates to a light assembly, and particularly to devices for shedding light on a workpiece during operation of a power tool, such as a hand-held rotary power tool.

Hand-held power tools have been used by individuals for many decades. Such individuals include craftsman, repairman, hobbyists, and woodworkers to name a few. From the day that the power drill replaced the brace and bit, hand-held tools have greatly simplified most craft and/or repair projects and, perhaps most significantly, brought such projects within the grasp of the non-professional. Throughout its development, the power drill has been adapted to a variety of tasks, nearly all predicated on replacing the drill bit with a specialized tool. For instance, special bits have been developed for creating different types of holes in a workpiece. Other attachments allow a power drill to act as a screwdriver or sander. Still other attachment bits convert the power drill to a router capable of producing intricate patterns and scrollwork in a workpiece.

Power tools have evolved from the bulky pistol grip type drill to a more compact, "pencil" type tool. Smaller hand-held tools are available for performing very intricate cuts in a workpiece. Other hand-held power tools and attachments have been developed to allow a held-held drill to function like a coping saw or jig saw. In all of these applications, the ability to see the workpiece is critical. The development of smaller hand-held tools and streamlined support jigs has helped provide as un-obstructed view of the workpiece as possible. However, a clear view may be insufficient if the workpiece is not adequately illuminated.

A well lighted work area is obviously desirable, but is only half the battle. Even with the best stationary lighting, shadows can plague the home craftsman or repairman. Moreover, not all craft and/or repair operations need to occur at a well-lighted workbench. Consequently, there is a need for a light source that can be associated with a power tool and that eliminates the lighting problems that are present with prior work area lighting solutions. There is also a need for a light source that can be readily associated with a number of tools in the work shop.

SUMMARY OF THE INVENTION

The present invention addresses these needs by a light attachment that can be readily mounted on a variety of tools and/or tool support fixtures and/or other support structures. In one embodiment of the invention, the light attachment includes a light portion supported on a mounting portion by a flexible cable or gooseneck-type cable. The flexible cable can be bent to virtually any configuration and hold its shape so that the light portion can be positioned exactly at the location that requires illumination.

The mounting portion includes a housing that defines an attachment element configured to mate with a complementary attachment element formed on the power tool. Alternatively, the attachment element may be formed on a case for a power tool, or other fixture, and may even be formed on a clip device. In a preferred embodiment, the attachment element has a dovetail shape for sliding engagement within a complementary shaped notch in the body of the tool. The attachment element also includes a knob disposed at the end of a resilient arm. The knob is sized to fit within a dimple defined in the notch in the tool body and the resilient arm is arranged to deflect as the attachment element slides into the notch. When the knob is aligned over the dimple, the resilient arm urges the knob into the dimple to help hold the mounting portion, and therefore the light attachment, to the tool or tool support fixture or other support structure.

The housing of the mounting portion is configured to contain a power source for the light portion. In the preferred embodiment, the power source includes a number of flat batteries, such as a lithium ion batteries, coupled to power supply wires housed within the flexible cable.

The light portion of the light attachment incorporates the on-off switch into the light guide. The light portion includes a housing mounted to the flexible cable. The housing supports a printed circuit board to which the power supply wires are attached. The circuit board also carries a spring contact switch element that completes the circuit when it is pressed against the circuit board. Power is supplied through the circuit board and switch to an LED light element. The LED is disposed within the housing. The light guide is in threaded engagement with internal threads of the housing so that the guide can bear against the LED light element as it is threaded into the housing. Pressure on the LED light element causes a terminal thereof to depress the spring contact switch element to energize the LED light element. An O-ring can be engaged between the light guide and the housing to increase the frictional resistance to movement of the light guide.

The LED preferably includes a built-in refraction lens so that a lens is not required on the light guide. The built-in lens, which has a defined angle of refraction, thus focuses the light emitted by the LED onto the workpiece.

One benefit of the present invention is that it provides a light attachment that can be attached to a variety of tools or fixtures or other support structures to provide direct illumination where it is needed most. Another benefit is that the light emitting portion is carried by a flexible cable that allows positioning the light in an infinite number of positions.

A further benefit achieved by the light attachment of the present invention is that certain heavy components of the light attachment are contained at the mounting end of the light attachment so that its weight does not interfere with the ability to position the light source and hold that position. Yet another benefit is that the on-off switch is with the light source, or immediately adjacent the workpiece.

Other benefits and certain objects of the invention will become apparent from the following written description taken together with the accompanying figures.

DESCRIPTION OF THE PREFERRED EMBODIMENTS

Figure 1:
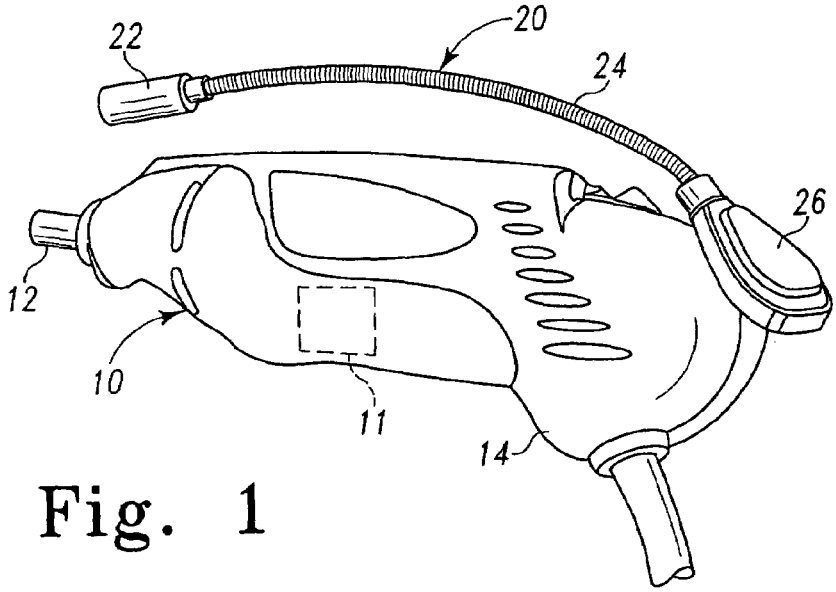
FIG. 1 is a perspective view of a hand-held tool with the light attachment mounted thereto in accordance with the principles of the present invention.

For the purposes of promoting an understanding of the principles of the present invention, reference will now be made to the embodiments illustrated in the drawings and described in the following written specification. It is understood that no limitation of the scope of the invention is thereby intended. It is further understood that the present invention includes any alterations and modifications to the illustrated embodiments and includes further applications of the principles of the invention as would normally occur to one skilled in the art to which this invention pertains.

The present invention is particularly suited for use with a hand-held tool, such as a rotary hand-held power tool 10 shown in FIG. 1. The power tool 10 includes a working end 12 that can be a collet for attachment of various rotary tool bits, such as bits for grinding, sharpening, routing, cutting, carving, engraving, cleaning, polishing, and sanding. The tool 10 includes a body 14 that houses drive and control components (schematically shown by reference numeral 11) for the tool. The distal end 15 (i.e., the end of the tool opposite the working end 12) is configured to support a light attachment 20 according to one embodiment of the present invention.

The light attachment 20 includes a light portion 22, a flexible cable (or conduit) 24 and a mounting portion 26. The flexible cable 24 is a gooseneck cable that can be bent to assume one of an infinite number of positions, and can maintain that position. The gooseneck cable 24 can be constructed in a known manner to exhibit this formable rigidity or stiffness. For instance, a typical gooseneck cable includes a pair of concentrically disposed spiral-wound tubes. The outer radius of the spirals of the inner tube is substantially equal to the inner radius of the spirals of the outer tube so that the static friction force between the inner and outer tubes tends to keep the gooseneck cable in a fixed position when no forces are being applied thereto. The cable 24 is hollow to allow passage of power wires 66 (see FIGS. 8–9).

Figure 2:
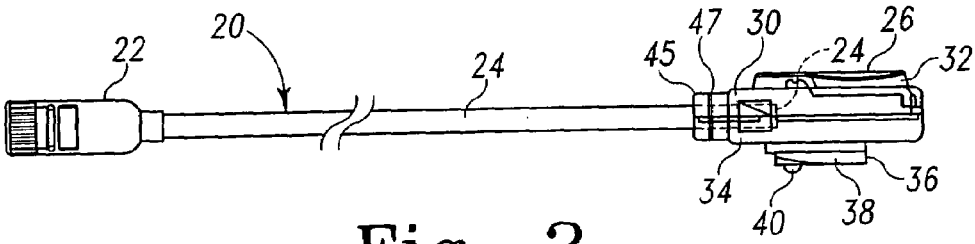
FIG. 2 is a side elevational view of the light attachment shown in FIG. 1, with the light attachment repositioned to assume a substantially linear orientation.
Figure 3:
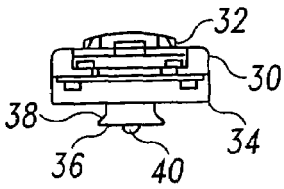
FIG. 3 is an end elevational view of the mounting portion of the light attachment shown in FIG. 2.
Figure 4:
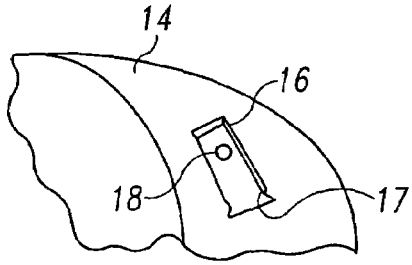
FIG. 4 is an enlarged partial perspective view of an attachment feature on the hand-held tool shown in FIG. 1 for use with the light attachment of the present invention.
Figure 5:
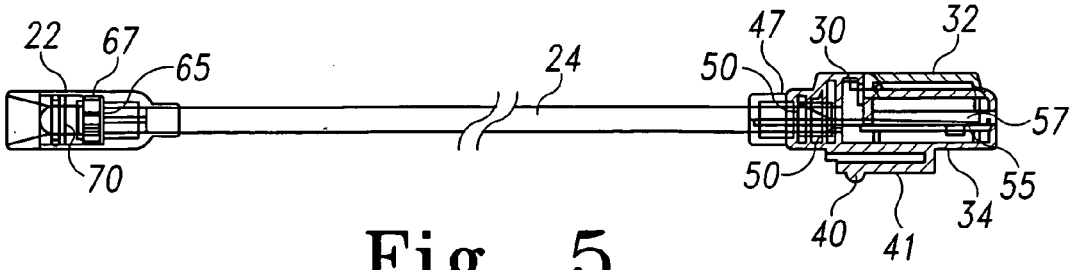
FIG. 5 is a side partial cross-sectional view of the light attachment shown in FIG. 2.
Figure 6:
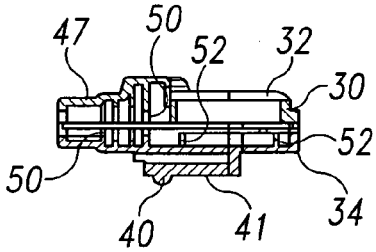
FIG. 6 is a cross-sectional view of the mounting portion housing of the light attachment shown in FIG. 5.

In the preferred embodiment, the mounting portion 26 includes three basic components. In particular, the mounting portion includes a top cover 30, a battery cover 32 that snaps onto the top cover, and a bottom cover 34. The top and bottom covers can snap together or, preferably, are affixed such as by sonic welding or use of an adhesive. Alternatively, screws may be used to affix such parts together. The bottom cover 34 includes an attachment element 36 that is configured to engage a complementary attachment feature 16 located at the distal portion 15 of the body 14 of the tool 10 (see FIG. 4). The attachment components are male-female type attachment elements that can be positively engaged. For instance, as seen in FIGS. 2 and 3, the attachment element 36 is in the form of a dovetail 38 that slides in a friction fit manner within a complementary-shaped notch or cavity 17 defined in structure attached to the tool body 14. Alternatively, such structure may be integrally formed as a part of the tool body 14. In order to further hold the attachment element 36 to the attachment feature 16, the dovetail is provided with a knob 40 formed at the end of a resilient arm 41, as best seen in FIGS. 5–6. The arm 41 is biased to the position shown in the figures with the knob 40 extending below the dovetail structure 38, although the arm can be resiliently deflected upward into a cavity 42 formed in the dovetail structure. When the dovetail structure 38 is slid into the notch 17, the resilient arm deflects upward as the knob 40 bears on the surface of the tool body. When the dovetail is fully seated within the notch 17, the knob 40 is aligned with a dimple 18 formed within the notch. The resilient arm 41 urges the knob into the dimple to further hold the attachment element 36 within the attachment feature 16 of the tool body 14. The knob can be disengaged and the mounting portion 26 removed from coupling relationship with the tool 10 by a applying a slight force against the mounting portion.

The top and bottom covers 30, 34 cooperate to define a shackle 45 that surrounds the flexible cable 24 as it extends into the mounting portion 26. A collar 47 surrounds the shackle to press the shackle about the cable to help hold the assembly together. In addition, the interior of the top and bottom covers can define a series of strain relief ridges 50. These ridges 50 press into the exterior of the flexible cable disposed within the mounting portion to hold the cable within the covers. The ridges provide a strain relief function as they resist but don't prevent separation of the flexible cable from the mounting portion under sufficient force.

Figure 7:
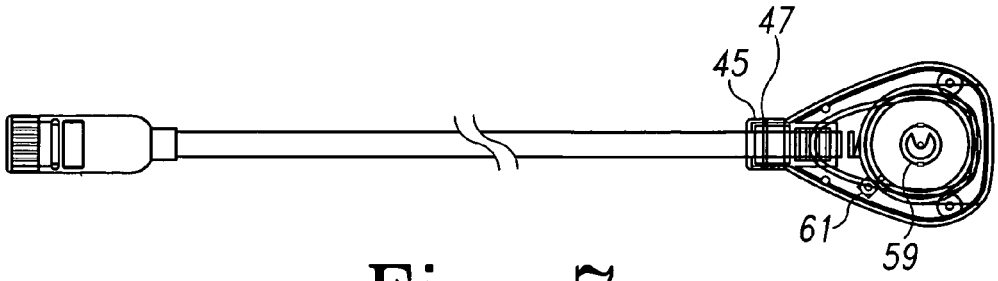
FIG. 7 is a top partial cut-away view of the light attachment shown in FIG. 5.

The bottom cover 34 defines supports 52 (FIG. 6) for a printed circuit board 55 (FIG. 5) mounted therein. The circuit board is connected to the power wires 66 (FIGS. 8–9) that pass through the flexible cable and that are electrically connected to the light portion 22. The circuit board 55 also electrically interfaces with a battery assembly 57 supported within the top cover 30. The battery assembly is accessible for replacement through the battery cover 32. The top cover and battery cover combine to support a positive terminal 59 (FIG. 7) and a negative terminal 61 for electrical contact with the cathode and anode of the battery assembly. Preferably, the battery assembly 57 includes a disc shaped battery stack. For instance, the battery assembly can include two 3 volt lithium ion (CR2025) batteries. The circuit board 55 provides an electrical interface between the battery assembly and the power wires.

Figure 8:
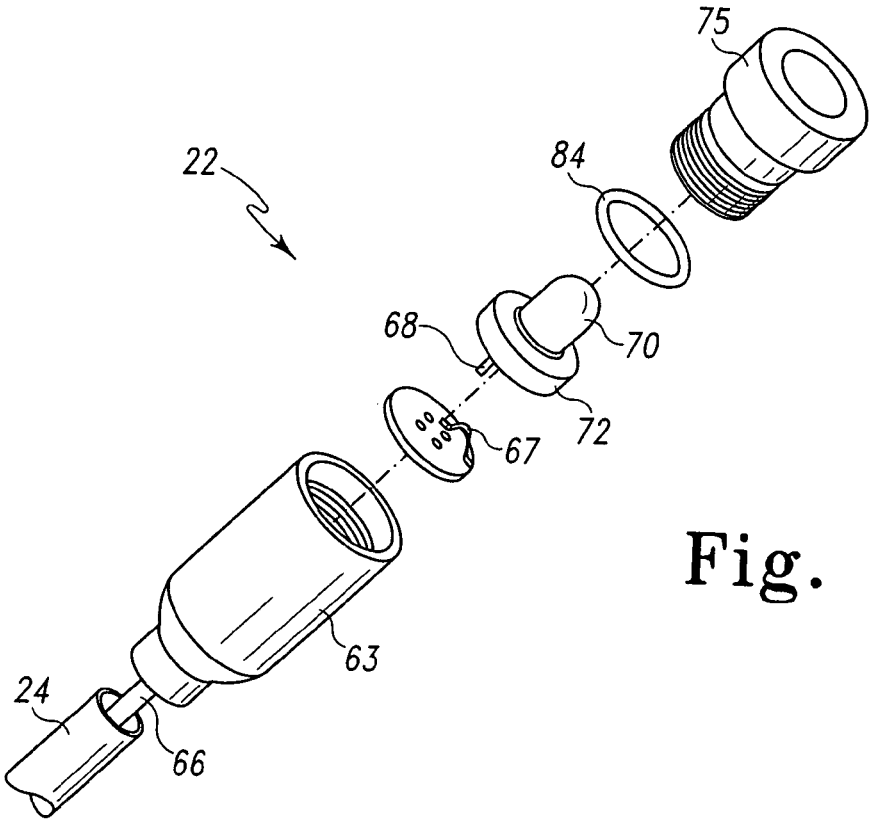
FIG. 8 is an enlarged exploded perspective view of the light portion of the light attachment shown in FIG. 1.
Figure 9:
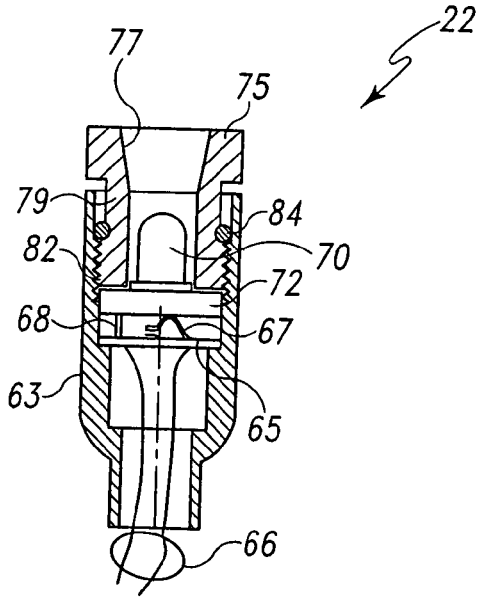
FIG. 9 is a side cross-sectional view of the light portion shown in FIG. 8.

Referring to FIGS. 8–9, the light portion 22 includes a housing 63 that is affixed to the free end of the flexible cable 24. The housing can include a shackle 64 similar to the shackle 45 of the mounting portion to firmly connect the housing to the cable. The shackle 64 may be crimped or swaged over the flexible cable. The housing is hollow to receive the wires 66 therethrough and to support the components of the light portion 22. In the preferred embodiment, the light portion 22 includes a printed circuit board 65 that is electrically connected to the wires 66. The circuit board 65 supports a leaf spring contact switch 67 that includes one end portion that is biased away from the circuit board. The circuit board 65 further supports a power lead 68 that is connected to the base 72 of an LED light 70. The leaf spring contact switch 67 can be depressed toward the circuit board 65 so that the one end portion of the leaf spring contact switch makes electrical contact with a wire pad on the circuit board 65 while being in further electrical contact with a corresponding wire pad on the LED base 72 thereby completing an electrical circuit that includes the battery assembly 57 and the LED light 70. The switch and circuit board is configured so that the leaf spring contact switch 67 is normally biased to a "break" (or open circuit) position, but can be depressed, as discussed above, to a "make" (or closed circuit) position.

The switch 67 is actuated by rotation of a light guide 75 that is threaded into the mouth of the housing 63. The lower portion of the light guide 75 includes external threads that mate with internal threads 83 defined within the housing. The lower portion of the light guide 75 bears against the base 72 of the LED 70 with the LED projecting into a bore 77 of the light guide. As shown in FIG. 9, the bore 77 can be outwardly flared to widen the light beam leaving the light portion. In a preferred embodiment, the LED 70 includes a built-in refraction lens 71 that eliminates the need for a lens across the mouth of the light guide 75. The built-in lens is preferably configured to focus the light emitted by the LED 70 to a relatively narrow beam so that the maximum candlepower can be focused on the workpiece.

As the light guide 75 is threaded into the housing 63, the lower portion pushes down on the LED base 72. As the base slides within the housing it pushes down on the spring switch 67 to close the switch and make the electrical circuit. As the light guide is threaded out of the housing, the pressure on the spring switch is relieved and the natural resilience of the switch causes it to deflect upward.

In one aspect of the invention, the interface between the light guide 75 and the housing 63 is such that the light guide resists unthreading under upward pressure from the spring switch 67. In order to enhance this resistance, the light portion 22 includes an O-ring 84 disposed between the light guide and the housing, as shown in FIG. 9. The O-ring resists translation within the housing, which ultimately resists movement of the light guide into or out of the housing. The frictional resistance generated by the O-ring 84 is sufficient to hold the position of the light guide against the upward force of the spring switch, but not so great as to make manually threading the light guide into the housing too difficult.

The light attachment 20 beneficially retains the battery assembly in the mounting portion 26 so that the weight of the battery assembly can be easily borne by the tool itself. This arrangement eliminates the additional weight of the battery assembly in the light portion 22 which can compromise the ability of the flexible gooseneck cable 24 to hold the position of the light portion. On the other hand, the on-off switch is incorporated into the housing and light guide of the light portion 22 so that the light can be easily turned on or off near the location of the workpiece.

Figure 10:
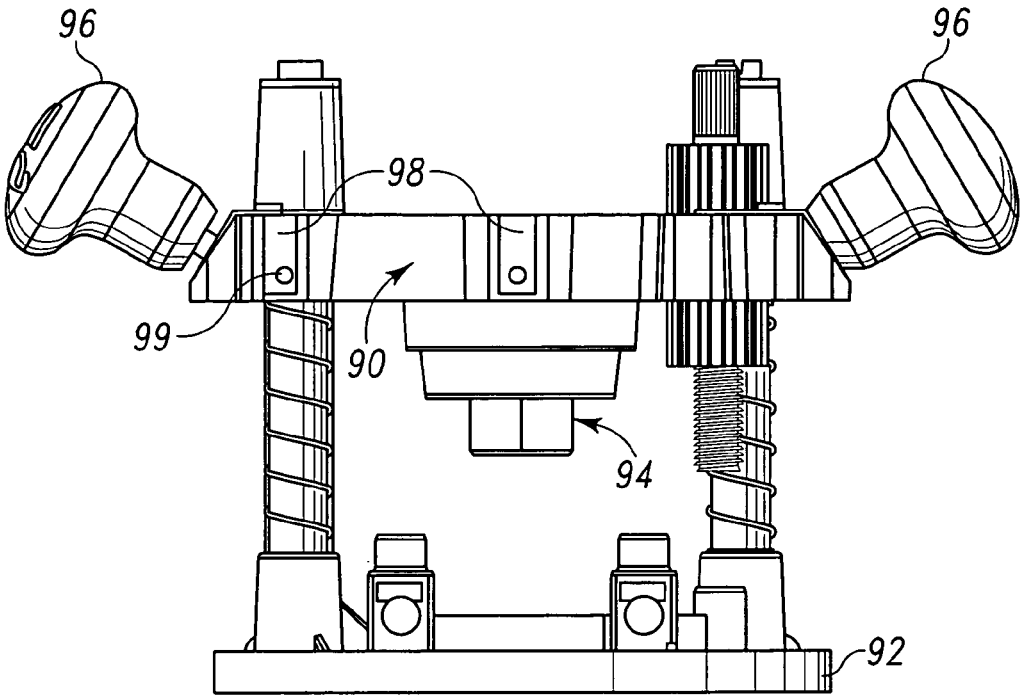
FIG. 10 is a side elevational view of a tool support fixture configured for use with the light attachment in accordance with the principles of the present invention.

The light attachment 20 is configured to be mounted to wide range of tools and tool support fixtures and other support structures, provided they include an appropriate attachment feature, such as the feature 16 of (or on) the tool body 14. For instance, as shown in FIG. 10, a tool support fixture 90 is provided for supporting a tool, such as the tool 10 shown in FIG. 1. The fixture includes an engagement nut 94 that fixes the tool to the fixture 90. For instance, the tool 10 is provided with external threads on its body that mate with internal threads of the nut 94 to secure the tool 10 to the fixture 90. A pair of handles 96 is provided to permit stable manipulation of the fixture and the tool mounted within the fixture.

The fixture includes several attachment features 98 which are identical to the attachment feature 16 described above. Thus, the fixture 90 provides multiple locations at which the light attachment 20 can be supported on the fixture. The flexible cable 24 can be manipulated so that the light portion 22 is optimally positioned to direct a light beam in a meaningful direction. Moreover, the multiple attachment features 98 can support several light attachments to illuminate the workpiece from multiple directions.

Figure 11:
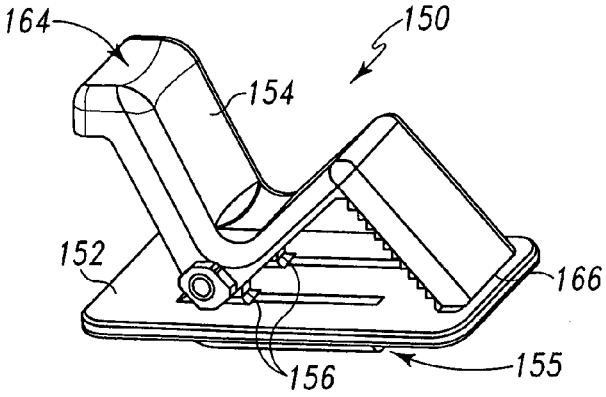
FIGS. 11–14 are various distinct perspective views of a clip device to which the light attachment of FIG. 2 may be mounted in accordance with the principles of the present invention.
Figure 12:
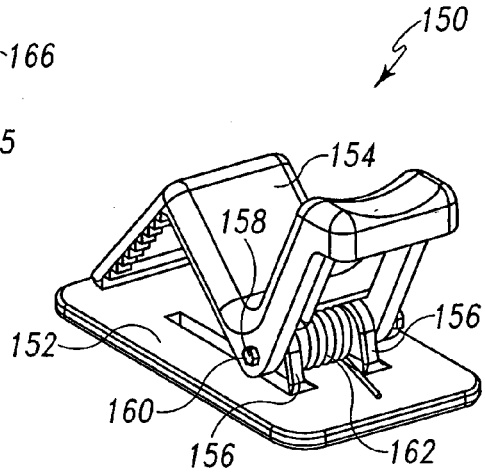
Figure 13:
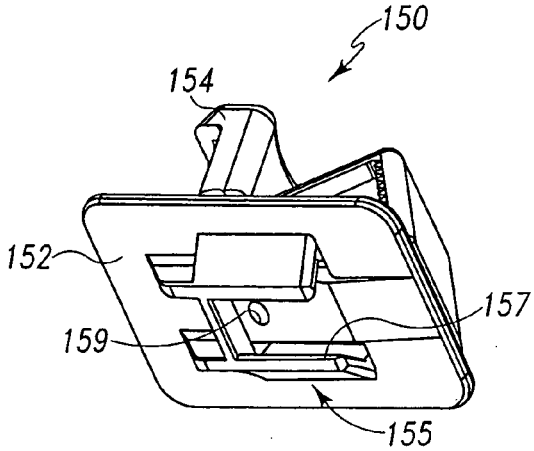
Figure 14:
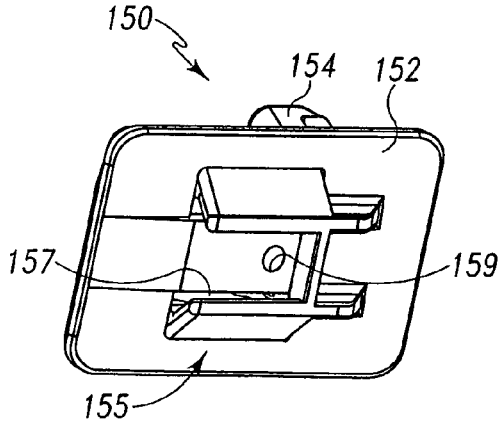

The light attachment tool 20 is also configured to be mounted to a clip device 150 that is shown in FIGS. 11–14. The clip device 150 includes a base (or support structure) 152 and a clip arm 154 pivotally mounted to the base 152. The base 154 includes an attachment element 155 (see FIGS. 13–14) that is configured to engage with the dovetail attachment element 36 of the light attachment 20 (see e.g. FIGS. 2–3). The attachment element 155 is substantially identical to the attachment feature 16 described above. In particular, the attachment element 155 defines a dovetail shaped cavity 157 as shown in FIGS. 13–14 that is configured to receive the dovetail structure 38 of the attachment element 36 in a friction fit manner so as to hold the light attachment 20 in fixed relation to the clip device 150. The base 152 further has defined therein a dimple 159 that is configured to receive the knob 40 of the attachment element 36 (see FIGS. 2–3) so as to enhance the integrity of the coupling between the light attachment 20 and the clip device 150.

The base 152 further has a pair of spaced apart mounts 156, each having a hole (not shown) defined therein. Similarly, the clip arm 154 has a pair of holes 158 respectively aligned with the holes defined in the pair of spaced apart mounts 156. A rod 160 extends through the aligned holes of the mounts 156 and the clip arm 154 so as to provide a pivotal coupling therebetween as best shown in FIG. 12. A spring 162 is positioned around the rod 160 and arranged to bias the clip arm 154 to its closed position as best shown in FIGS. 11–12. However, upon application of force to the clip arm 154 at location 164, the clip arm 154 pivots about the rod 160 so as to provide an opening between the end portion 166 of the spring arm 154 and the base 152. Then, the clip device may be attached to any appropriate support object (e.g. a work bench) by simply locating a part of the support object in the opening, and thereafter, removing the application of force to the clip arm at the location 164.

The clip device 150 may conveniently be packaged and sold together as a kit with the light attachment 20 and/or the power tool 10. The clip device 150 provides significant benefits since it may be mounted on any appropriate structure in the vicinity of a workpiece to thereby provide a mount for receiving the mounting portion 26 of the light attachment 20. Other benefits of the present invention are derived since both the power tool 10 and the clip device 150 possess a similarly configured dovetail cavity thereby providing the user the option to either mount the light attachment 20 directly to the power tool 10, or alternatively mount the light attachment 20 to the clip device for custom mounting on any appropriate structure in the vicinity of the workpiece (e.g. a work bench).

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A light and support assembly, comprising:

a light apparatus having (i) a light generating device, (ii) a battery housing, (iii) a first attachment mechanism secured to said battery housing, (iii) an elongate support conduit interposed between said light generating device and said battery housing, and (iv) a power source disposed within said battery housing, and (v) wiring extending through said elongate support conduit and electrically coupling said light generating device to said power source; and a support structure having a second attachment mechanism configured to mate with said first attachment mechanism, wherein said first attachment mechanism of said light apparatus includes one of a dovetail shaped element and a dovetail shaped cavity, and wherein said second attachment mechanism of said support structure includes the other of said dovetail shaped element and said dovetail shaped cavity.

2. The assembly of claim 1, wherein said support structure includes a housing for functional components of a power tool.

3. The assembly of claim 2, wherein said power tool is a rotary tool.

4. The assembly of claim 1, wherein said support structure includes a tool support fixture configured to couple to a power tool.

5. The assembly of claim 4, wherein said power tool is a rotary tool.

6. The assembly of claim 1, wherein said support structure includes a clip device configured to mount to an object.

7. The assembly of claim 6, wherein said clip device includes:

a base, and a clip arm movably coupled to said base.

8. The assembly of claim 7, wherein:

said clip is movable between an open position and a closed position, and said clip is spring biased toward said closed position.

9. The assembly of claim 1, wherein said light generating device includes an LED.

10. The assembly of claim 9, wherein said LED includes a built-in refraction lens.

11. The assembly of claim 1, wherein said power source includes at least one battery.

12. The assembly of claim 1, wherein said power source includes a plurality of disc shaped batteries.

13. The assembly of claim 1, wherein:

said dovetail shaped element includes a knob extending from a surface thereof, said support structure has a dimple defined therein which is located in said dovetail shaped cavity, and said knob is located in said dimple when said first attachment mechanism is mated with said second attachment mechanism.

14. The assembly of claim 1, wherein said elongate support conduit includes a gooseneck cable extending between said light generating device and said battery housing.

15. The assembly of claim 1, wherein said light generating device includes a switch for selectively coupling and decoupling said light generating device from said power source.

16. The assembly of claim 15, wherein:

said light generating device further includes a light housing and a rotatable member, said switch includes a spring mounted within said light housing and movable between an open circuit position and a closed circuit position, and rotation of said rotatable member in relation to light housing causes said spring to move from said open circuit position to said closed circuit position.

17. The assembly of claim 16, wherein:

said light housing includes a set of internal threads, and said rotatable member includes a set of external threads that mate with said set of internal threads.

18. The assembly of claim 16, wherein said switch further includes an O-ring positioned between said rotatable member and said light housing to inhibit movement therebetween.

19. The assembly of claim 1, wherein:

said support structure includes a power tool housing for functional components of a rotary power tool, a first end portion of said power tool housing defines an opening through which a rotating member of said rotary power tool extends, said second attachment mechanism is located at a second end portion of said power tool housing that is opposite said first end portion.

20. The assembly of claim 19, wherein said functional components of said rotary power tool includes drive and control components of said rotary power tool.

21. The assembly of claim 19, wherein:

said light apparatus has a first length said power tool housing has a second length, and said first length is equal to or greater than said second length.

22. The assembly of claim 1, wherein:

said support structure includes a power tool housing for functional components of a rotary power tool, said power tool housing defines an opening at a first end thereof through which a rotating member of said rotary power tool extends, said second attachment mechanism is located at a second end of said power tool housing that is opposite said first end, and said light apparatus spans the length of said power tool housing so as to position said light generating device adjacent to said opening.

23. A light assembly, comprising:

a light generating device;

a battery housing;

an attachment mechanism supported by said battery housing, said attachment mechanism including one of a dovetail shaped element and a dovetail shaped cavity;

an elongate support conduit interposed between said light generating device and said battery housing;

a power source disposed within said battery housing; and wiring extending through said elongate support conduit and electrically coupling said light generating device to said power source.

24. The assembly of claim 23, wherein said light generating device includes an LED.

25. The assembly of claim 24, wherein said LED includes a built-in refraction lens.

26. The assembly of claim 23, wherein said power source includes at least one battery.

27. The assembly of claim 23, wherein said power source includes a plurality of disc shaped batteries.

28. The assembly of claim 23, wherein:

said attachment mechanism includes said dovetail shaped element, and said dovetail shaped element includes a knob extending from a surface thereof.

29. The assembly of claim 23, wherein said elongate support conduit includes a gooseneck cable extending between said light generating device and said battery housing.

30. The assembly of claim 23, wherein said light generating device includes a switch for selectively coupling and decoupling said light generating device from said power source.

31. The assembly of claim 30, wherein:

said light generating device further includes a light housing and a rotatable member, said switch includes a spring mounted within said light housing and movable between an open circuit position and a closed circuit position, and rotation of said rotatable member in relation to light housing causes said spring to move from said open circuit position to said closed circuit position.

32. The assembly of claim 31, wherein:

said light housing includes a set of internal threads, said rotatable member includes a set of external threads that mate with said set of internal threads.

33. The assembly of claim 31, wherein said switch further includes an O-ring positioned between said rotatable member and said light housing to inhibit movement therebetween.

* * * * *